US006863751B1

(12) United States Patent
Chan et al.

(10) Patent No.: US 6,863,751 B1
(45) Date of Patent: Mar. 8, 2005

(54) MINIMUM SIGNATURE PROPELLANT

(75) Inventors: May L. Chan, Ridgecrest, CA (US); Alan D. Turner, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 105 days.

(21) Appl. No.: 10/716,980

(22) Filed: Nov. 14, 2003

Related U.S. Application Data

(62) Division of application No. 09/820,374, filed on Mar. 26, 2001.

(51) Int. Cl.[7] ..... C06B 45/10
(52) U.S. Cl. ..... 149/19.5
(58) Field of Search ..... 149/19.1, 19.2, 149/19.3, 19.4, 19.5, 19.6, 19.7, 19.8, 19.9, 19.91

(56) References Cited

U.S. PATENT DOCUMENTS 4,916,206 A * 4/1990 Day et al. ..... 528/272
5,468,313 A * 11/1995 Wallace et al. ..... 149/53
5,529,649 A * 6/1996 Lund et al. ..... 149/19.3
5,712,511 A 1/1998 Chan et al.
6,074,581 A 6/2000 Wood et al.
6,135,746 A 10/2000 Wood et al.
6,362,311 B1 * 3/2002 Highsmith et al. ..... 528/409

OTHER PUBLICATIONS

A. I. Atwood, P. O. Curran, C. F. Price, T. L. Boggs, D. Booth, High Pressure Burning Rate Studies of Ammonium Perchlorate (AP) Based Propellants, Proceedings for Research and Technology Agency of North Atlantic Treaty Organization (NATO) 1999 Meeting on Small Rocket Motors and Gas Generators for Land, Sea, and Air Launched Weapon Systems, Apr. 19–23, 1999, pp. 43–1—43–8, Corfu, Greece.

* cited by examiner

*Primary Examiner*—John R. Hardee
(74) *Attorney, Agent, or Firm*—Charlene A. Haley

(57) ABSTRACT

This invention relates to energetic compositions, which offer increased performance in conjunction with a total absence of halogen based oxidizers to eliminate exhaust products, such as hydrogen chloride. The oxidizers of choice are various combinations neat ammonium dinitramide, ammonium dinitramide prills and CL-20, because these oxidizers do not produce halogen containing exhaust products, such as the HCl gas of ammonium perchlorate. The exhaust these novel propellants consist mostly of $CO_2$, $H_2O$, $N_2$, and small amounts of CO. These exhaust species are friendlier and much less hazardous to the environment than those emitted by conventional AP-based propellants. The plasticizers are selected from energetic plasticizers that do not contain halogens, but maintain other desirable properties.

13 Claims, 5 Drawing Sheets

MINIMUM SIGNATURE PROPELLANT

CROSS-REFERENCE TO RELATED APPLICATIONS

This is a divisional application, claiming the benefit of, parent application Ser. No. 09/820,374 filed on Mar. 26, 2001, whereby the entire disclosure of which is incorporated hereby reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

This invention relates to propellant formulations and plastic bonded explosive compositions. More particularly, this invention relates to energetic compositions, which offer increased performance in conjunction with a total absence of halogen based oxidizers to eliminate exhaust products, such as hydrogen chloride.

BACKGROUND OF THE INVENTION

State-of-the-art propellant formulations, at their most basic level, are composed of an oxidizer and a fuel. The combustion reaction undergone by these two materials provides the energy necessary to propel the rocket or missile. Since the oxidizer/fuel combination must sustain the stresses of handling, aging, storage and use, it is typically compounded in a formula consisting of binder, plasticizer and various solid ingredients. Ideally, all the components in the formulation act as either oxidizers or fuels, contributing to the energy necessary for maximum propulsion performance, although in practice, certain necessary ingredients such as stabilizers and bum rate catalysts/modifiers, have little or no energy to impart to the reaction.

The performance of the propellant is directly proportional to the enthalpy release of the oxidizer and fuel ingredients as they undergo combustion, and inversely proportional to the molecular weight of the gases produced in the combustion reaction. In practice, some tradeoffs are necessary to gain the best performance from available ingredients and formulations. Aluminum, for instance, is a fuel whose combustion products are relatively high in molecular weight, and are in most cases, not gases at all, but solids. However, the enthalpy release by the combustion of aluminum is so great in proportion to anything, which would otherwise be available as a fuel ingredient, that the metal is commonly used as a fuel in high-performance tactical and strategic rocket motor applications. Another material commonly utilized, despite some drawbacks, is the oxidizer ammonium perchlorate. This material has a high negative enthalpy of formation, limiting its energy release upon combustion, and, in addition, it produces hydrogen chloride upon combustion, a relatively high-molecular-weight toxic gas. However, ammonium perchlorate is inexpensive, easy to formulate, has very tractable ballistics and favorable burn characteristics, and so, despite its limitations, it is the state-of-the-art oxidizer for most solid propellant rocket motor formulations.

Ammonium dinitramide (ADN) is a very powerful organic oxidizer that can replace ammonium perchlorate (AP) in propellant compositions. ADN has the following formula:

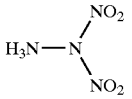

Calculations have shown that, when incorporated in propellant formulations, the ADN propellant can achieve performance equal to or higher than that of the conventional hydroxyl-terminated polybutadiene (HTPB)/AP propellant. Most desirably, ADN propellants do not produce toxic hydrogen chloride (HCl) in the exhaust. In addition, the use of ADN in propellant formulations greatly minimizes the secondary smoke problem caused primarily by the nucleation of HCl. Because of their environmentally friendly characteristics and demonstrated low toxicity of their exhaust products to humans, ADN propellants are highly desirable. In recent years, investigators have been designing propellant formulations that try to embody the advantages of ADN as a solid oxidizer.

The need to have missiles fly farther, higher and faster and to carry heavier payloads is a constant tactical and strategic factor. Higher performance is always needed. In volume-limited systems, this performance can only come about by increases in the quantity, density or energy of the propellant formulation, by decreases in the weight of the inert hardware and the airframe, and by operating at higher pressures. A new requirement has come to light in recent years: that the formula and its combustion products be nondegrading to the environment. In the light of these requirements, state-of-the-art propellant formulations utilizing conventional binders, ammonium perchlorate and aluminum have been developed and refined to the maximum extent possible and these compositions will necessarily begin to fall behind in performance compared to newer developments. In addition, the political and environmental concerns with the toxic and corrosive hydrogen chloride present in the exhaust of rockets utilizing these formulations will result in demands to replace such formulations with more innocuous compositions.

ADN material synthesized at Bofors, Sweden has developed a new synthesis route for ADN. This new synthesis technique is the result of collaboration between the scientists at Bofors and at the National Defense Research Establishment of Sweden. This new synthesis route, illustrated in FIG. 1, can drastically reduce the cost of ADN manufacturing in comparison to the methods previously used.

U.S. Pat. No. 6,074,581 issued to Wood et al. on Jun. 13, 2000, incorporated herein by reference, discloses a method of producing ADN prills using molten ADN and mineral oil emulsion technology. The ADN prills produced using the process of the '581 patent have a particle size of 20–350 $\mu$m. U.S. Pat. No. 6,135,746 issued to Wood et al. on Oct. 24, 2000, incorporated herein by reference, discloses an apparatus for producing ADN prills using molten ADN and mineral oil emulsion technology. The ADN prills produced using the process of the '746 patent have a particle size of about 20 to about 350 $\mu$m.

Another method of producing ADN prills involves the use a prilling tower in which ADN particles pass through a hot air zone and are fused into rounded spheres. During this prilling process, 0.5% urea is added as the thermal stabilizer and 0.2% carbosil is added to prevent moisture pick-up. These ADN prills have an average particle size of about 100 to about 200 $\mu$m.

SUMMARY OF THE INVENTION

As minimum signature propellants, the formulations of the present invention avoid the use of metal fuel, such as aluminum, and halogen containing ingredients, such as ammonium perchlorate (AP) oxidizer and trifluoroethyl-terminated poly (1-cyano-1-difluorarmino)-polyethylene glycol (PCDE) polymer. In other embodiments of the present formulations, the oxidizers of choice are neat ADN, ADN prills and CL-20, because these oxidizers do not produce halogen containing exhaust products, such as the HCl gas of AP. The plasticizers are selected from energetic plasticizers that do not contain halogens, but maintain other desirable properties. The exhaust consists mostly of $CO_2$, $H_2O$ , $N_2$, and small amounts of CO. These exhaust species are friendlier and much less hazardous to the environment than those emitted by conventional AP-based propellants.

Neat ADN having a particle size in the range of about 20 to about 60 $\mu$m is used in a preferred embodiment of the present invention. The ADN prills used in a preferred embodiment of the present invention have a particle size in the range of about 20 to about 300 $\mu$m.

The present invention provides a minimum signature propellant, which can deliver improved performance Isp. The present invention also provides propellant compositions, which utilize ADN prills and neat ADN as organic oxidizes as a replacement for AP in propellant compositions.

The present propellant compositions can achieve performance equal to or higher than that of the conventional hydroxyl-terminated polybutadiene (HTPB)/AP propellant. Embodiments of the present invention provides minimum signature propellants, which avoid the use of metal fuel, such as aluminum, and halogen containing ingredients, such as ammonium perchlorate (AP) oxidizer and trifluoroethyl-terminated poly (1-cyano-1-difluoramino)-polyethylene glycol (PCDE) polymer. Other propellant compositions utilize ADN in combination with CL-20 as organic oxidizers to achieve performance equal to or higher than current propellant compositions.

The propellant compositions further utilize ADN in combination with various energetic binders too. Additionally, the present invention provides minimum signature propellant compositions, which can sustain good burning rates at pressures up to 8000 psia with no pressure slope break.

It is to be understood that the foregoing general description and the following detailed description are exemplary and explanatory only and are not to be viewed as being restrictive of the present invention, as claimed. These and other objects, features and advantages of the present invention will become apparent after a review of the following detailed description of the disclosed embodiments and the appended claims.

DETAILED DESCRIPTION

Figure 1:
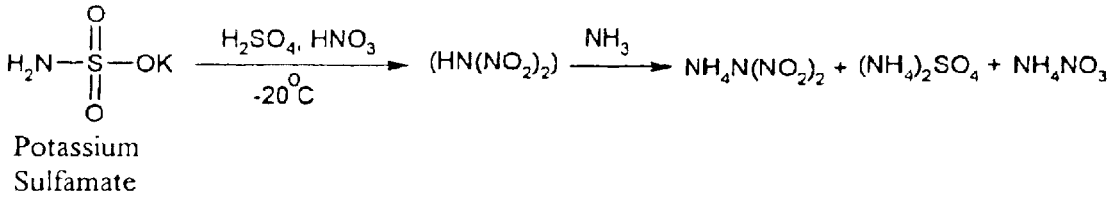
FIG. 1 is illustrates a synthesis route for the production of ADN known in the art.

The crystalline ADN is given the name "neat ADN" and the spherical shaped like ADN is given the name "ADN prills". In a preferred embodiment of the present invention, the ADN material appears to be in either crystalline form, neat ADN, or spherical shaped, ADN prills, with a particle size of 5 to 300 $\mu$m. ADN prills used in a preferred embodiment of the present invention have an average size of about 100 to about 200 $\mu$m. Neat ADN used in embodiments of the present invention has a particle size of about 20 to about 60 $\mu$m.

ADN prills are produced by several processes. One process involves molten ADN and mineral oil emulsion technology. This process produces ADN prills, which have a particle size of about 20 to about 300 $\mu$m. When incorporated in propellant mixes, the prills generated with this technique improved the propellant's processibility by lowering its viscosity and enhanced its flow.

Another process produces ADN prills using a prilling tower. These prills can withstand 100° C. for 48 hours with minimum or no weight loss, while the neat ADN loses up to 12% its mass under the same conditions. These prills have an average particle size of about 100 to about 200 $\mu$m. The ADN prills having an average particle size of about 100 to about 200 $\mu$m were used in the propellant formulations of embodiments of the present invention.

As minimum signature propellants, the present invention avoids the use of metal fuel, including aluminum, and halogen containing ingredients, including ammonium perchlorate (AP) oxidizer and trifluoroethyl-terminated poly (1-cyano-1-difluoramino)-polyethylene glycol (PCDE P-2) plasticizer. In embodiments of the present formulations, the oxidizers of choice are neat ADN, ADN prills and CL-20, because these oxidizers do not produce halogen containing exhaust products, including HCl gas of AP. The plasticizers are selected from energetic plasticizers that do not contain halogens, but maintain other desirable properties.

In other embodiments of the present invention, high-energy, minimum-signature propellants use ADN as the single oxidizer or by using a combination of CL-20 and ADN as the oxidizers. Based on theoretical calculations, these propellants give a specific impulse (Isp) of 265 seconds at standard operating conditions (1000 exit to 14.7 psia). This value is substantially higher than Isp values obtained with conventional minimum-signature propellants.

The energetic plasticizer is selected from those compounds, which are liquids and contain energetic moieties or groups in their chemical structures. These moieties can include nitro or nitrate ester groups, azido groups, nitramino groups. Examples include butanetriol trinitrate (BTTN), trimethylolethane trinitrate (TMETN), triethylene glycol dinitrate (TEGDN), nitroglycerine (NG) glycidyl azide polymer terminated with azide or (GAP azide or GAP Plasticizer), bis-(2,2-dinitropropyl) acetal/formal (BDNPF/A), and n-butyl-2-nitratoethyl-nitramine (bu-NENA). In other embodiments of the present invention, the plasticizer is BTTN, TMETN and bu-NENA or, more preferably, a combination thereof.

The binder is selected from those oligomers and polymers known as "energetic binders." Energetic binders may be energetic compounds themselves, such as azides, nitrate esters or nitrocompounds, which have been polymerized into oligomers with prosthetic groups on the ends of the polymers for crosslinking or curing. Also, Energetic may be oligomers or polymers of organic esters, ethers, lactones which have the property of absorbing large amounts of energetic plasticizers (typically at least three times their weight) without exudation or degradation of mechanical properties. Examples of the former include glycidyl azide polymer (GAP), the copolymer of (bis-azidoethyl) oxetane (BAMO) with (3-nitratomethyl-3-methyl) oxetane (NMMO), called BAMO/NMMO, other polymers or copolymers of the same type utilizing such molecules as 3-azidomethyl-3-methyl oxetane (AMMO), poly (diethyleneglycol-4,8-dinitrazaundecanoate (ORP-2A), bis-nitratomethyl) oxetane (BNMO) and the like, and polyglycidyl nitrate (Poly Glyn). Examples of the latter include polyethylene glycol (PEG), polypropylene glycol (PPG), hydroxy-terminated polycaprolactones, hydroxy-terminated polyesters, hydroxy-terminated polyethers (HTPE) and combinations of these polymers and oligomers; i.e, hydroxy-terminated polycaprolactone ether (HTCE). In a preferred embodiment of the present invention, the energetic binders selected are polycaprolactone (PCP), ORP-2A and Poly Glyn.

Referring to Table 1A, solid rocket propellant formulations, according to embodiments of the present invention, given the acronyms PCP/NE/ADN, PCP/NE/ADN/ADNP and PCP/NE/ADNP/CL-20 are formulated from the following ingredients:

TABLE 1A

| | weight % of each ingredient | | |
|---|---|---|---|
| Composition | PCP/NE/ADN | PCP/NE/ADN/ADNP | PCP/NE/ADNP/CL-20 |
| ADN, neat 20–60 μm | 55–68 | 17–25 | — |
| ADN, prills 100–200 μm | — | 35–45 | 25–45 |
| Binder (PCP 6000) | 6.0–9.2 | 6.0–9.2 | 6.0–9.2 |
| CL-20 | — | — | 15–25 |
| Crosslinker (Nitrocellulose) | 0.7–1.2 | 0.7–1.2 | 0.7–1.2 |
| Plasticizer (BTTN) | 4–6 | 4–6 | 4–6 |
| Plasticizer (TMETN) | 10–13 | 10–13 | 10–13 |
| Plasticizer (Bu-NENA) | 7–9 | 7–9 | 7–9 |
| Cure Catalyst (TPB) | 0.03–0.10 | 0.03–0.1 | 0.03–0.10 |
| Burn Rate Modifier (Carbon Black) | 1.0–1.5 | 1.0–1.5 | 1.0–1.5 |
| Stabilizer (MNA) | 0.4–0.6 | 0.4–0.6 | 0.4–0.6 |
| Activator (DNSA) | 0.03–0.05 | 0.03–0.5 | 0.03–0.05 |
| Curative (N-100 ™) | 1.0–1.2 | 1.0–2. | 1.0–2.0 |

Other embodiments of the present invention, the binder incorporated for PCP/NE/ADN, PCP/NE/ADN/ADNP and PCP/NE/ADNP/CL20 is PCP (polycaprolactone). Other suitable binders include polyethylene glycol, copolymer of polyethylene glycol, polypropylene glycol and copolymer of polypropylene glycol as noted above. In embodiments of the present invention relating to PCP/NE/ADN, PCP/NE/ADN/ADNP and PCP/NE/ADNP/CL-20, the polymeric binder comprises about 6.0–9.2 weight % of the formulation, preferably at about 8.6 weight %.

Suitable plasticizers include TEGDN, (triethyleneglycol dinitrate), Butyl NENA, (n-butyl-2-nitratoethyl-nitramine), DEGDN (diethyleneglycol dinitrate), TMETN (trimethylolethane trinitrate), and BTTN (butanetriol trinitrate). These plasticizers may be used independently or in combination. In other embodiments of the present invention relating to PCP/NE/ADN, PCP/NE/ADN/ADNP and PCP/NE/ADNP/CL-20, one plasticizer used in the formulation is a combination of BTTN, TMETN and bu-NENA. BTTN comprises about 4.0–6.0 weight % of the formulation, or about 5.2 weight %, TMETN comprises about 10–13 weight % of the formulation, or about 8.5 weight %, and bu-NENA comprises about 7.0–9.0 weight % of the formulation, or about 12.7 weight %.

In the formulation PCP/NE/ADN, neat ADN having a particle size of 20 to 60 μm is used as the sole oxidizer. In embodiments of the present invention, the PCP/NE/ADN formulation comprises about 55 to about 68 weight %, preferably about 60 weight %, of the neat ADN. In the formulation PCP/NE/ADN/ADNP, neat ADN having a particle size of 20 to 60 μm is used as the first oxidizer. Other embodiments of the present invention, the PCP/NE/ADN/ADNP formulation comprises about 17 to about 25 weight %, or about 22 weight %, of the neat ADN and about 35 to about 45 weight %, preferably about 40 weight %, of ADN prills having a particle size of 100 to 200 μm as a second oxidizer. In other embodiments of the present invention, the formulation PCP/NE/ADNP/CL-20 comprises about 25 to about 45 weight %, or about 37 weight %, of ADN prills having a particle size of 100 to 200 μm as a first oxidizer and about 15 to about 25 weight %, or about 25 weight %, of CL-20 having an average particle size of 3.0 μm as a second oxidizer.

The basic formulation of PCP/NE/ADN, PCP/NE/ADN/ADNP and PCP/NE/ADNP/CL-20 consists of a binder, plasticizer and one or more oxidizers. However, cure catalysts, curatives, crosslinkers, thermal and aging stabilizers, burn rate catalyst, activator, opacifiers and other such ingredients commonly utilized in solid propellant formulations may be added, depending upon the desired characteristics.

A suitable stabilizer is MNA (N-methyl-p-nitroaniline). Other suitable stabilizers for nitrate esters include 4-NDPA (4-nitrodiphenylamine), and other stabilizers well known in the art. In other embodiments of the present invention relating to PCP/NE/ADN, PCP/NE/ADN/ADNP or PCP/NE/ADNP/CL-20, MNA is incorporated at about 0.4–0.6 weight %, or at about 0.5 weight %.

A curative can also be added to the formulation, and examples of suitable curatives include polyfunctional isocyanates, including HMDI (hexamethylene diisocyanate), TMXDI (m-tetramethylxylene diisocyanate), DDI (dimeryl diisocyanate), TDI (toluene diisocyanate), polymeric hexamethylene diisocyanate, IPDI (isophorone diisocyanate) and Desmodur N-100™ (biuret triisocyanate) as commercially available from Mobay. These curatives may be used independently or in combination. In other embodiments of the present invention relating to PCP/NE/ADN, PCP/NE/ADN/ADNP or PCP/NE/ADNP/CL-20, N-100 is incorporated at about 1.0–2.0 weight %, or at about 1.9 weight %.

TPB (triphenyl bismuth) is a suitable cure catalyst. Other suitable cure catalysts include TPTC (triphenyltin chloride), dibutyltin diacetate, and dibutyltin dilaurate. These compounds and others may be used as needed to prepare a propellant formulation with the specific desired characteristics. In other embodiments of the present invention relating to PCP/NE/ADN, PCP/NE/ADN/ADNP or PCP/NE/ADNP/CL-20, TPB comprises about 0.03–0.10 weight % of the formulation, or at about 0.03 weight %. In addition, DNSA (3,5-dinitrosalicylic acid) may be used as an activator for the cure catalyst. In other embodiments of the present invention relating to PCP/NE/AND, PCP/NE/ADN/ADNP or PCP/NE/ADNP/CL-20, DNSA comprises about 0.03–0.05 weight % of the formulation, or at about 0.03 weight %.

Carbon black is a suitable bum rate modifier. The surface area of carbon black in other embodiments of the present invention is about 81 $m^2/g$. In yet other embodiments of the present invention relating to PCP/NE/AND, PCP/NE/ADN/ADNP or PCP/NE/ADNP/CL-20, the carbon black comprises about 1.0–1.5 weight % of the formulations, or at about 1.0 weight Nitrocellulose is a suitable crosslinker, which improves the propellant mechanical properties. In other embodiments of the present invention relating to PCP/NE/AND, PCP/NE/ADN/ADNP or PCP/NE/ADNP/CL-20, the nitrocellulose comprises about 0.7–1.2 weight % of the formulations, or at about 0.7 weight %.

Referring to Table 1B, solid rocket propellant formulations, according to embodiments of the present invention, given the acronyms ORP-2A/NE/AND, ORP-2A/NE/ADN/ADNP, and ORP-2A/NE/ADNP/CL-20 are formulated from the following ingredients:

TABLE 1B

| | Weight % of each ingredient | | |
|---|---|---|---|
| Composition | ORP-2A/NE/ADN | ORP-2A/NE/ADN/ADNP | ORP-2A/NE/ADNP/CL-20 |
| ADN, neat 20–60 μm | 50–65 | 17–25 | — |
| ADN, prills 100–200 μm | — | 35–45 | 25–45 |
| Binder (ORP-2A) | 6–9 | 6–9 | 6–9 |
| CL-20 | — | — | 15–25 |
| Crosslinker (Nitrocellulose) | 0.7–1.2 | 0.7–1.2 | 0.7–1.2 |
| Plasticizer (BTTN) | 5–12 | 5–12 | 5–12 |
| Plasticizer (TMETN) | 15–22 | 15–22 | 15–22 |
| Cure Catalyst (TPB) | 0.03–0.10 | 0.03–0.10 | 0.03–0.10 |
| Burn Rate Modifier (Carbon Black) | 1.0–1.5 | 1.0–1.5 | 1.0–1.5 |
| Stabilizer (MNA) | 0.4–0.6 | 0.4–0.6 | 0.4–0.6 |
| Activator (DNSA) | 0.03–0.05 | 0.03–0.05 | 0.03–0.05 |
| Curative (N-100 ™) | 1.0–2.0 | 1.0–2.0 | 1.0–2.0 |

In preferred embodiments of the present invention, the binder incorporated for ORP-2A/NE/AND, ORP-2A/NE/ADN/ADNP, and ORP-2A/NE/ADNP/CL-20 is ORP-2A (poly(diethyleneglycol-4,8-dinitrazaundecanoate). Other suitable binders include polyethylene glycol, copolymer of polyethylene glycol, polypropylene glycol and copolymer of polypropylene glycol as noted above. In a preferred embodiment of the present invention relating to ORP-2A/NE/AND, ORP-2A/NE/ADN/ADNP, and ORP-2A/NE/ADNP/CL-20, the polymeric binder comprises about 6.0–9.0 weight % of the formulation, preferably at about 6.8 weight %.

Suitable plasticizers include TEGDN, (triethyleneglycol dinitrate), Butyl NENA, (n-butyl-2-nitratoethyl-nitramine), DEGDN (diethyleneglycol dinitrate), TMETN (trimethylolethane trinitrate), and BTTN (butanetriol trinitrate). These plasticizers may be used independently or in combination. In other embodiments of the present invention relating to ORP-2A/NE/AND, ORP-2A/NE/ADN/ADNP, and ORP-2A/NE/ADNP/CL-20, one plasticizer used in the formulation is a combination of BTTN and TMETN. BTTN comprises about 5.0–12 weight % of the formulation, or about 11.8 weight %, and TMETN comprises about 15–22 weight % of the formulation, or about 15.5 weight %.

In the formulation ORP-2A/NE/ADN, neat ADN having a particle size of 20 to 60 μm is used as the sole oxidizer. In other embodiments of the present invention, the ORP-2A/NE/ADN formulation comprises about 50 to about 65 weight %, or about 60 weight %, of the neat ADN. In embodiments of the present invention, the formulation ORP-2A/NE/ADN/ADNP comprises about 17 to about 25 weight %, or about 22 weight % of neat ADN having a particle size of 20 to 60 μm as the first oxidizer and about 35 to about 45 weight %, or about 40 weight %, of ADN prills having a particle size of 100 to 200 μm as a second oxidizer. In yet other embodiments of the present invention, the formulation ORP-2A/NE/ADNP/CL-20 comprises about 25 to about 45 weight %, or about 37 weight %, of ADN prills having a particle size of 100 to 200 μm as a first oxidizer and about 15 to about 25 weight %, or about 25 weight %, of CL-20 having an average particle size of 3.0 μm as a second oxidizer.

The basic formulation of ORP-2A/NE/AND, ORP-2A/NE/ADN/ADNP, and ORP-2A/NE/ADNP/CL-20 consist of a binder, plasticizer and one or more oxidizers. However, cure catalysts, curatives, crosslinkers, thermal and aging stabilizers, burn rate modifier, bum rate catalyst, opacifiers and other such ingredients commonly utilized in solid propellant formulations may be added, depending upon the desired characteristics.

A suitable stabilizer is MNA (N-methyl-p-nitroaniline). Other suitable stabilizers for nitrate esters include 4-NDPA (4-nitrodiphenylamine), and other stabilizers well known in the art. In embodiments of the present invention relating to ORP-2A/NE/AND, ORP-2A/NE/ADN/ADNP, and ORP-2A/NE/ADNP/CL-20, MNA is incorporated at about 0.4–0.6 weight %, or at about 0.5 weight %.

A curative can also be added to the formulation, and examples of suitable curatives include polyfunctional isocyanates, including HMDI (hexamethylene diisocyanate), TMXDI (m-tetramethylxylene diisocyanate), DDI (dimeryl diisocyanate), TDI (toluene diisocyanate), polymeric hexamethylene diisocyanate, IPDI (isophorone diisocyanate) and Desmodur N-100™ (biuret triisocyanate) as commercially available from Mobay. These curatives may be used independently or in combination. In other embodiments of the present invention relating to ORP-2A/NE/AND, ORP-2A/NE/ADN/ADNP, and ORP-2A/NE/ADNP/CL-20, N-100 is incorporated at about 1.0–2.0 weight %, or at about 1.9 weight %.

TPB (triphenyl bismuth) is a suitable cure catalyst. Other suitable cure catalysts include TPTC (triphenyltin chloride), dibutyltin diacetate, and dibutyltin dilaurate. These compounds and others may be used as needed to prepare a propellant formulation with the specific desired characteristics. In other embodiments of the present invention relating to ORP-2A/NE/AND, ORP-2A/NE/ADN/ADNP, and ORP-2A/NE/ADNP/CL-20, TPB comprises about 0.03–0.10 weight % of the formulation, or at about 0.03 weight %. In addition, DNSA (3,5-dinitrosalicylic acid) may be used as an activator for the cure catalyst. In other embodiments of the present invention relating to ORP-2A/NE/AND, ORP-2A/NE/ADN/ADNP, and ORP-2A/NE/ADNP/CL-20, DNSA comprises about 0.03–0.05 weight %of the formulation, or at about 0.03 weight %.

Carbon black is a suitable burn rate modifier. The surface area of carbon black in a preferred embodiment of the present invention is about 81 $m^2/g$. In a preferred embodiment of the present invention relating to ORP-2A/NE/AND, ORP-2A/NE/ADN/ADNP, and ORP-2A/NE/ADNP/CL-20, the carbon black comprises about 1.0–1.5 weight % of the formulations, preferably at about 1.0 weight %.

Nitrocellulose is a suitable crosslinker, which improves the propellant mechanical properties. In other embodiments of the present invention relating to ORP-2A/NE/AND, ORP-2A/NE/ADN/ADNP, and ORP-2A/NE/ADNP/CL-20, the nitrocellulose comprises about 0.7–1.2 weight % of the formulations, or at about 0.7 weight %.

Referring to Table 1B, solid rocket propellant formulations, according to embodiments of the present invention, given the acronyms

TABLE 1C

| Composition | Weight % of each ingredient | |
|---|---|---|
| | PolyGly/TMETN/BTTN/ADN | PolyGlyn/TMETN/BTTN/ADNP/CL-20 |
| ADN, neat 20–60 μm | 50–60 | — |
| ADN, prills 100–200 μm | — | 25–45 |
| Binder (PolyGlyn) | 6–10.5 | 6–10.5 |
| CL-20 | — | 15–25 |
| Crosslinker (Nitrocellulose) | 0.7–1.2 | 0.7–1.2 |
| Plasticizer (BTTN) | 0–7 | 0–7 |
| Plasticizer (TMETN) | 10–15 | 10–15 |
| Plasticizer (Bu-NENA) | 2–10 | 2–10 |
| Cure Catalyst (TPB) | 0.03–0.10 | 0.03–0.10 |
| Burn Rate Modifier (Carbon Black) | 1.0–1.5 | 1.0–1.5 |
| Stabilizer (MNA) | 0.4–0.6 | 0.4–0.6 |
| Activator (DNSA) | 0.03–0.05 | 0.03–0.05 |
| Curative (N-100 ™) | 1.0–2.0 | 1.0–2.0 |

In embodiments of the present invention, the binder incorporated for PolyGlyn/TMETN/BTTN/ADN and PolyGlyn/TMETN/BTTN/ADNP/CL-20 is PolyGlyn (polyglycidyl nitrate). Other suitable binders include polyethylene glycol, copolymer of polyethylene glycol, polypropylene glycol and copolymer of polypropylene glycol as noted above. In other embodiments of the present invention relating to PolyGlyn/TMETN/BTTN/ADN and PolyGlyn/TMETN/BTTN/ADNP/CL-20, the polymeric binder comprises about 6.0–10.5 weight % of the formulation, or at about 9.0 weight %.

Suitable plasticizers include TEGDN, (triethyleneglycol dinitrate), Butyl NENA, (n-butyl-2-nitratoethyl-nitramine), DEGDN (diethyleneglycol dinitrate), TMETN (trimethylolethane trinitrate), and BTTN (butanetriol trinitrate). These plasticizers may be used independently or in combination. In embodiments of the present invention relating to PCP/NE/ADN, PCP/NE/ADN/ADNP and PCP/NE/ADNP/CL-20, one plasticizer used in the formulation is a combination of BTTN, TMETN and bu-NENA. BTTN comprises about 0–7.0 weight % of the formulation, or about 5.0 weight %, TMETN comprises about 10–15 weight % of the formulation, or about 12 weight %, and bu-NENA comprises about 2.0–10 weight % of the formulation, or about 9.9 weight %.

In the formulation PolyGlyn/NE/ADN, neat ADN having a particle size of 20 to 60 μm is used as the sole oxidizer. In other embodiments of the present invention, the PolyGlyn/NE/ADN formulation comprises about 50 to about 65 weight %, or about 60 weight %, of the neat ADN. In embodiments of the present invention, the formulation PolyGlyn/NE/ADNP/CL-20 comprises about 25 to about 45 weight %, or about 37 weight %, of ADN prills having a particle size of 100 to 200 μm as a first oxidizer and about 15 to about 25 weight %, or about 25 weight %, of CL-20 having an average particle size of 2.6 μm as a second oxidizer.

The basic formulation of PolyGlyn/TMETN/BTTN/ADN and PolyGlyn/TMETN/BTTN/ADNP/CL-20 consist of a binder, plasticizer and one or more oxidizers. However, cure catalysts, curatives, crosslinkers, thermal and aging stabilizers, burn rate catalyst, opacifiers and other such ingredients commonly utilized in solid propellant formulations may be added, depending upon the desired characteristics.

A suitable stabilizer is MNA (N-methyl-p-nitroaniline). Other suitable stabilizers for nitrate esters include 4-NDPA (4-nitrodiphenylamine), and other stabilizers well known in the art. In other embodiments of the present invention relating to PolyGlyn/TMETN/BTTN/ADN and PolyGlyn/TMETN/BTTN/ADNP/CL-20, MNA is incorporated at about 0.4–0.6 weight %, or at about 0.5 weight %.

A curative can also be added to the formulation, and examples of suitable curatives include polyfunctional isocyanates, including HMDI (hexamethylene diisocyanate), TMXDI (m-tetramethylxylene diisocyanate), DDI (dimeryl diisocyanate), TDI (toluene diisocyanate), polymeric hexamethylene diisocyanate, IPDI (isophorone diisocyanate) and Desmodur N-100™ (biuret triisocyanate) as commercially available from Mobay. These curatives may be used independently or in combination. In other embodiments of the present invention relating to PolyGlyn/TMETN/BTTN/ADN and PolyGlyn/TMETN/BTTN/ADNP/CL20, N-100 is incorporated at about 1.0–2.0 weight %, or at about 1.9 weight %.

TPB (triphenyl bismuth) is a suitable cure catalyst. Other suitable cure catalysts include TPTC (triphenyltin chloride), dibutyltin diacetate, and dibutyltin dilaurate. These compounds and others may be used as needed to prepare a propellant formulation with the specific desired characteristics. In embodiments of the present invention relating to PolyGlyn/TMETN/BTTN/ADN and PolyGlyn/TMETN/BTTN/ADNP/CL-20, TPB comprises about 0.03–0.10 weight % of the formulation, or at about 0.03 weight %. In addition, DNSA (3,5-dinitrosalicylic acid) may be used as an activator for the cure catalyst. In embodiments of the present invention relating PolyGlyn/TMETN/BTTN/ADN and PolyGlyn/TMETN/BTTN/ADNP/CL-20, DNSA comprises about 0.03–0.05 weight % of the formulation, or at about 0.03 weight %.

Carbon black is a suitable burn rate modifier. The surface area of carbon black in a preferred embodiment of the present invention is about 81 $m^2/g$. In other embodiments of the present invention relating to PolyGlyn/TMETN/BTTN/ADN and PolyGlyn/TMETN/BTTN/ADNP/CL-20, the carbon black comprises about 1.0–1.5 weight % of the formulations, or at about 1.0 weight %.

Nitrocellulose is a suitable crosslinker, which improves the propellant mechanical properties. In the formulations for PolyGlyn/TMETN/BTTN/ADN and PolyGlyn/TMETN/BTTN/ADNP/CL-20, nitrocellulose may be added to improve mechanical properties.

EXPERIMENTAL RESULTS

Five types of propellant binders were tested. The binders tested are as follows: PCP/NE, ORP-2A/NE, PolyGlyn/TMETN/BTTN, PolyGlyn/ButylNENA/TMETN, and PolyGlyn/ButylNENA/TMETN/BTTN. Referring to Table 2, NE is nitrate ester mixtures of butanetriol trinitrate (BTTN), trimethylolethane trinitrate (TMETN) and n-butyl-2-nitratoethyl-nitramine (bu-NENA); ADNP is ADN prills.

TABLE 2

| Formulation | ADN, wt % | ADN Prills, wt % | CL-20, wt % |
|---|---|---|---|
| PCP/NE/ADN | 60 | 0 | 0 |
| PCP/NE/ADN/ADNP | 22 | 40 | 0 |
| PCP/NE/ADNP/CL-20 | 0 | 37 | 25 |
| ORP-2A/NE/ADN | 60 | 0 | 0 |
| ORP-2A/NE/AND/ADNP | 22 | 40 | 0 |
| ORP-2A/NE/ADNP/CL-20 | 0 | 37 | 25 |
| PolyGlyn/TMETN/BTTN/ AND | 60 | 0 | 0 |
| PolyGlyn/TMETN/BTTN/ ADNP/CL-20 | 0 | 37 | 25 |
| PolyGlyn/NE/AND | 60 | 0 | 0 |
| PolyGlyn/ButylNENA/ TMETN/ADNP/CL-20 | 0 | 37 | 25 |

The total solids loading for these compositions is in the range of about 60 to about 62 weight %; the remainder represents the binder, curative, and other additives. The mixing is accomplished using methods known in the art. The mixing of the aforementioned ingredients is accomplished by using a vertical shear mixer. At the end of mixing, the propellant mixture is vacuum cast into various molds or test items to determine various characteristics. For a more detailed description of mixing technique, refer to U.S. Pat. No. 5,712,511 issued to Chan et al. on Jan. 27, 1998, incorporated by reference herein.

The ADN propellant samples have reasonable safety properties, as shown in Table 3. Conventional safety procedures were utilized to handle the hundreds of propellant samples generated and encountered no processing or handling problems. The resulting propellant samples are much more safer than the neat ADN or CL-20 materials. In Table 3 ABL is Allegany Ballistics Laboratory; ESD is electrostatic discharge; and NF is no fire. The Neat ADN and Neat CL-20 are used as reference materials for comparison.

TABLE 3

| Formulation | Impact, 50% Point | ABL Friction, 50% | ESD, 0.25 J |
|---|---|---|---|
| PCP/NE/AND | 10 cm | 759 lb | 10/10 NF |
| PCP/NE/ADNP/CL-20 | 16 cm | 631 lb | 10/10 NF |
| ORP-2A/NE/AND | 10 cm | 769 lb | 10/10 NF |
| ORP-2A/NE/ ADNP/CL-20 | 17 cm | 651 lb | 10/10 NF |
| PolyGlyn/TMETN/ BTTN/ AND | 12 cm | 832 lb | 10/10 NF |
| PolyGlyn/TMETN/ BTTN/ADNP/CL-20 | 17 cm | 724 lb | 10/10 NF |
| Neat ADN | 8–10 cm | 324–400 lb | 10/10 NF |
| Neat CL-20 | 10–12 cm | 200–300 lb | 10/10 NF |

The thermal properties of ADN and ADN/CL-20 propellants are shown in Table 4. The two exotherms are indicative of the thermal decomposition of ADN at 159–177° C. and CL-20 at 218–222° C. The thermal decomposition of ADN starts at the onset temperatures of 104–138° C. Good vacuum thermal stabilities were achieved. In Table 4 DSC is differential scanning calorimetry; TGA is thermogravimetric analysis; and VTS is vacuum thermal stability.

TABLE 4

| Formulation | DSC/TGA Onset, ° C. | DSC/TGA Exotherm, ° C. | VTS 80° C., $cm^3$/g/48 hr |
|---|---|---|---|
| PCP/NE/ADN | 132 | 170 | 0.17 |
| PCP/NE/ADNP/CL-20 | 138 | 172 and 218 | 0.1 |
| ORP-2A/NE/ADN | 104 | 159 | 0.126 |
| ORP-2A/NE/ADNP/CL-20 | 104 | 177 and 222 | — |
| PolyGlyn/TMETN/BTTN/ AND | 149 | 161 | 0.08 |
| PolyGlyn/TMETN/BTTN/ ADNP/CL-20 | 149 | 161 and 199 | 0.14 |

Propellant samples were prepared and their combustion properties were measured by window bomb combustion techniques. The burning rates were measured up to 8000 psia. All of the propellants exhibited good burning behavior, as shown in Table 5 and FIGS. 2 through 6.

Figure 2:
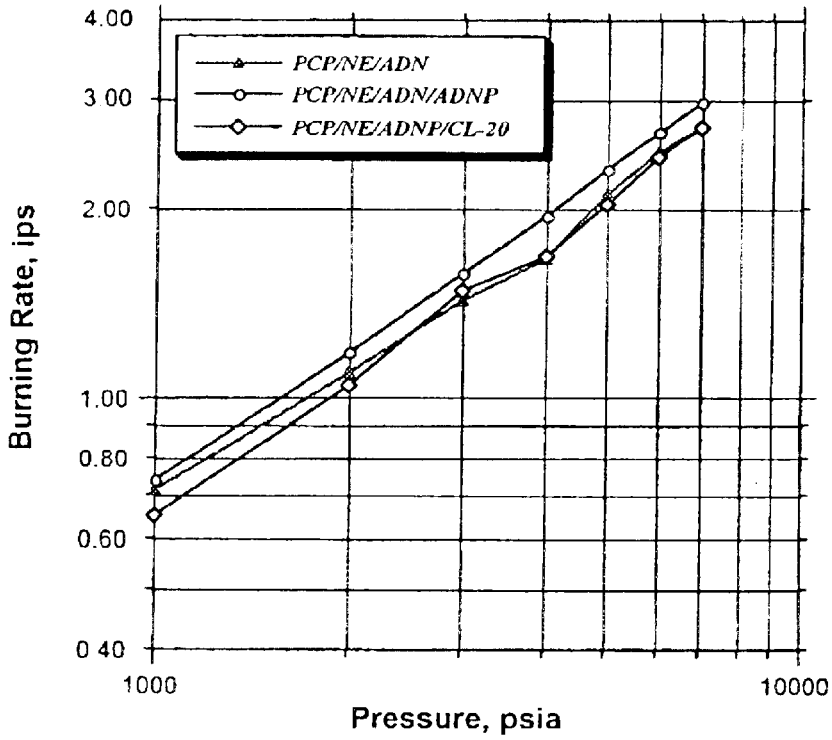
FIG. 2 is a graph, which illustrates the burn rate slope of preferred embodiments of the present invention in terms of chamber pressure versus burning rate for propellants containing PCP as a binder.

The propellants containing PCP as the binder—PCP/NE/ADN, PCP/NE/ADN/ADNP, and PCP/NE/ADNP/CL-20—burned in a very similar fashion (as shown in FIG. 2). Part of the ADN in the PCP/NE/ADN/ADNP formulation was replaced with prills; this substitution yielded a propellant with slightly higher (~5%) burning rates than those of the propellant containing only neat ADN. This slightly higher burning may also be due to some inhomogeneity in the prills (i.e., small voids or trapped mineral oil). Therefore, additional work needs to be conducted to verify the validity of the increased rates. The propellant containing a combination of ADN and CL-20 exhibited burning rates similar to those of the propellant containing all ADN. This phenomenon could be due to ADN having a greater influence on burning rate than CL-20 in these propellants because ADN burns much faster than CL-20 as a neat material; thus, the faster burning oxidizer dictates the bum rate of the propellant.

Figure 3:
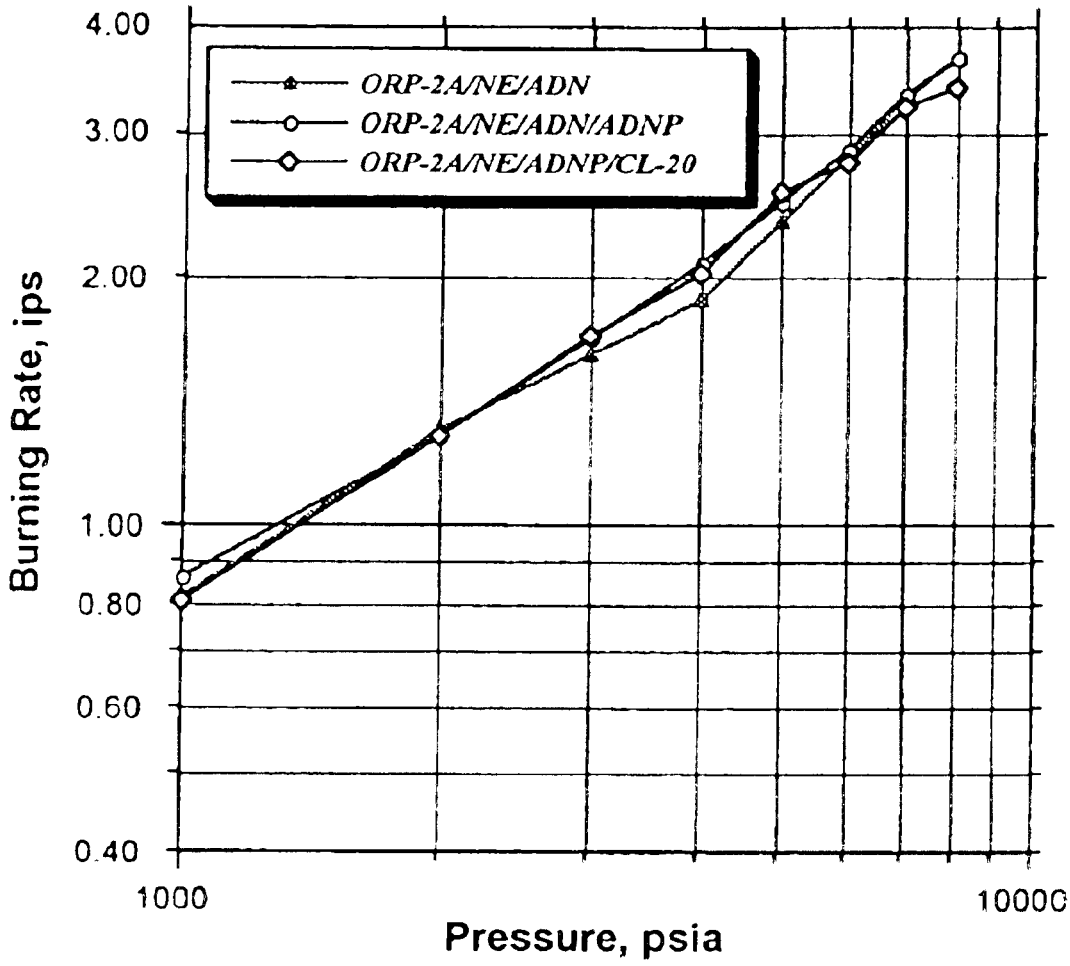
FIG. 3 is a graph, which illustrates the burn rate slope of preferred embodiments of the present invention in terms of chamber pressure versus burning rate for propellants containing ORP-2A as a binder.
Figure 4:
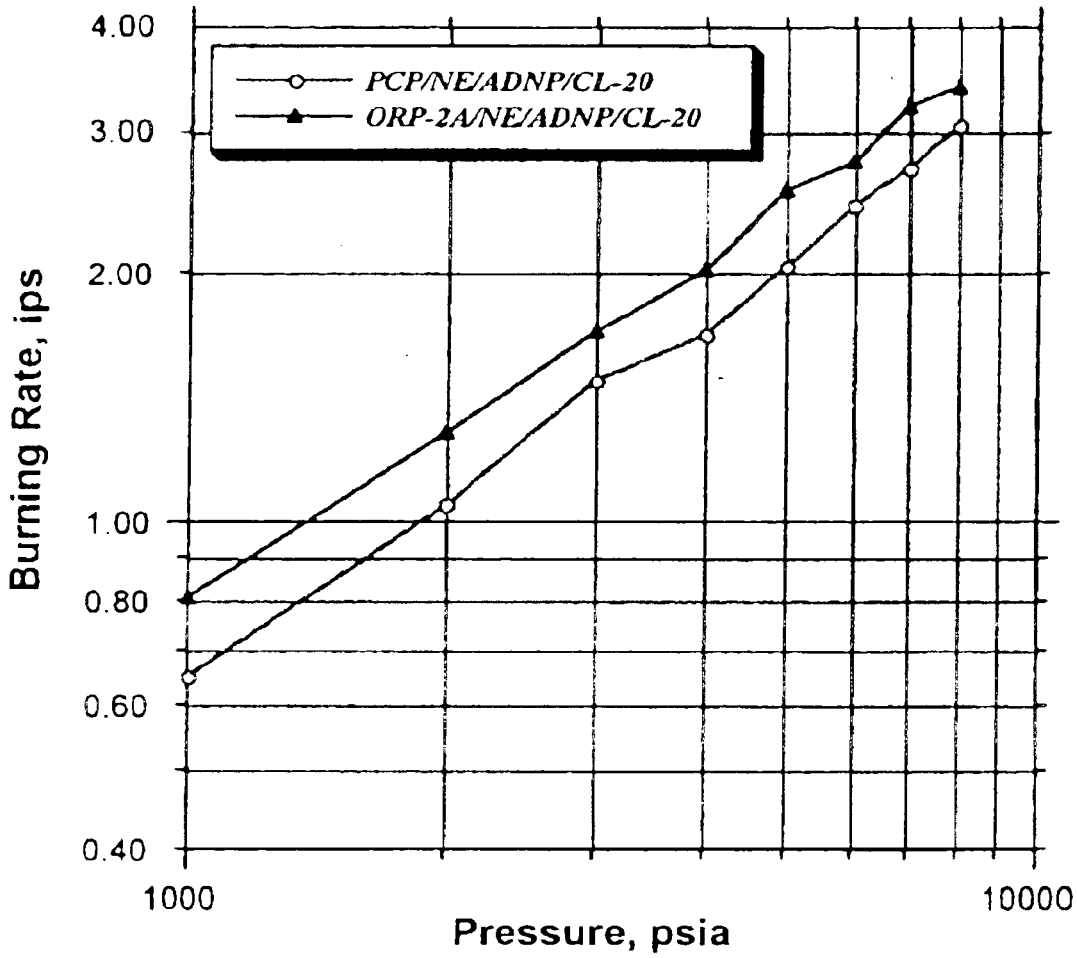
FIG. 4 is a graph, which illustrates a comparison of the burning rate slopes of preferred embodiments of the present invention in terms of chamber pressure versus burn rate.
Figure 5:
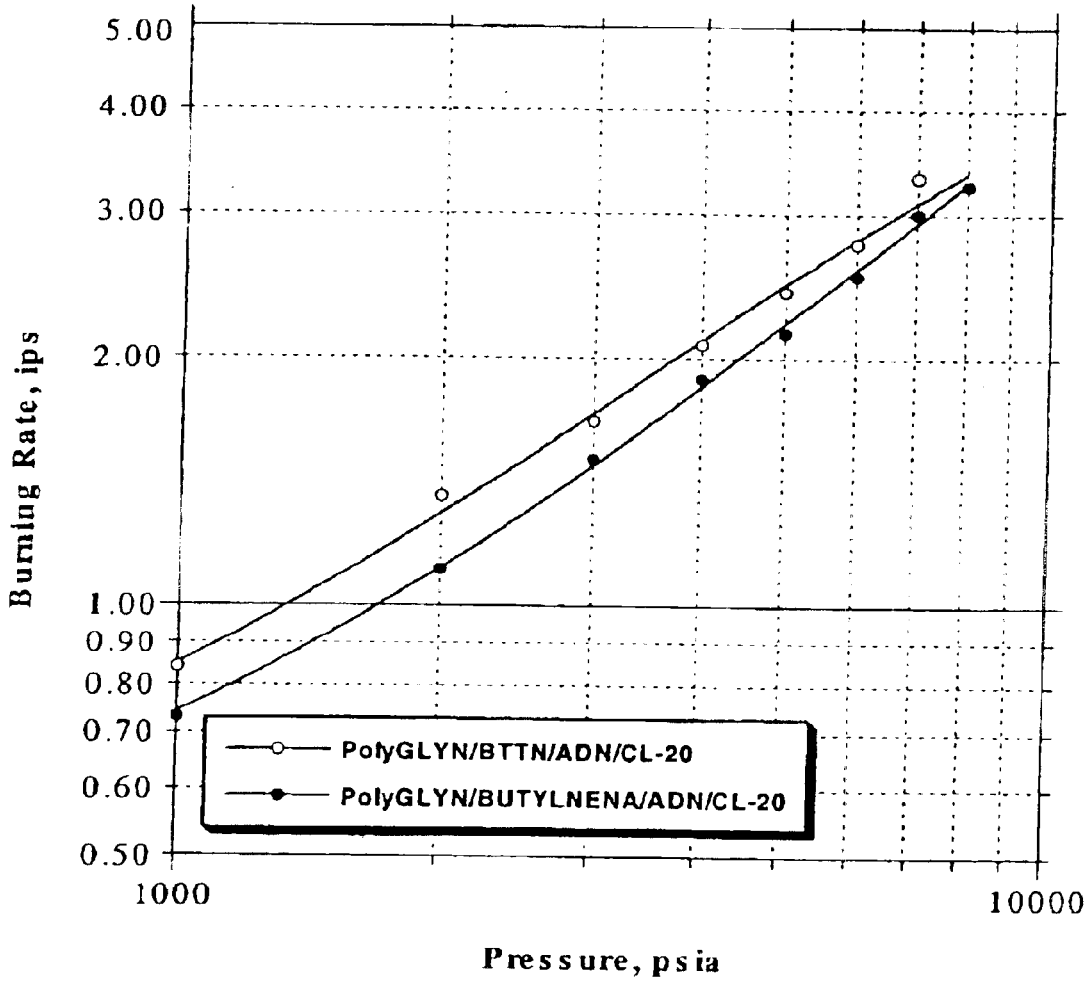
FIG. 5 is a graph which illustrates the burn rate slope of preferred embodiments of the present invention in terms of chamber pressure versus burning rate for propellants containing PolyGlyn as a binder and ADN/CL-20 as mixed oxidizer.
Figure 6:
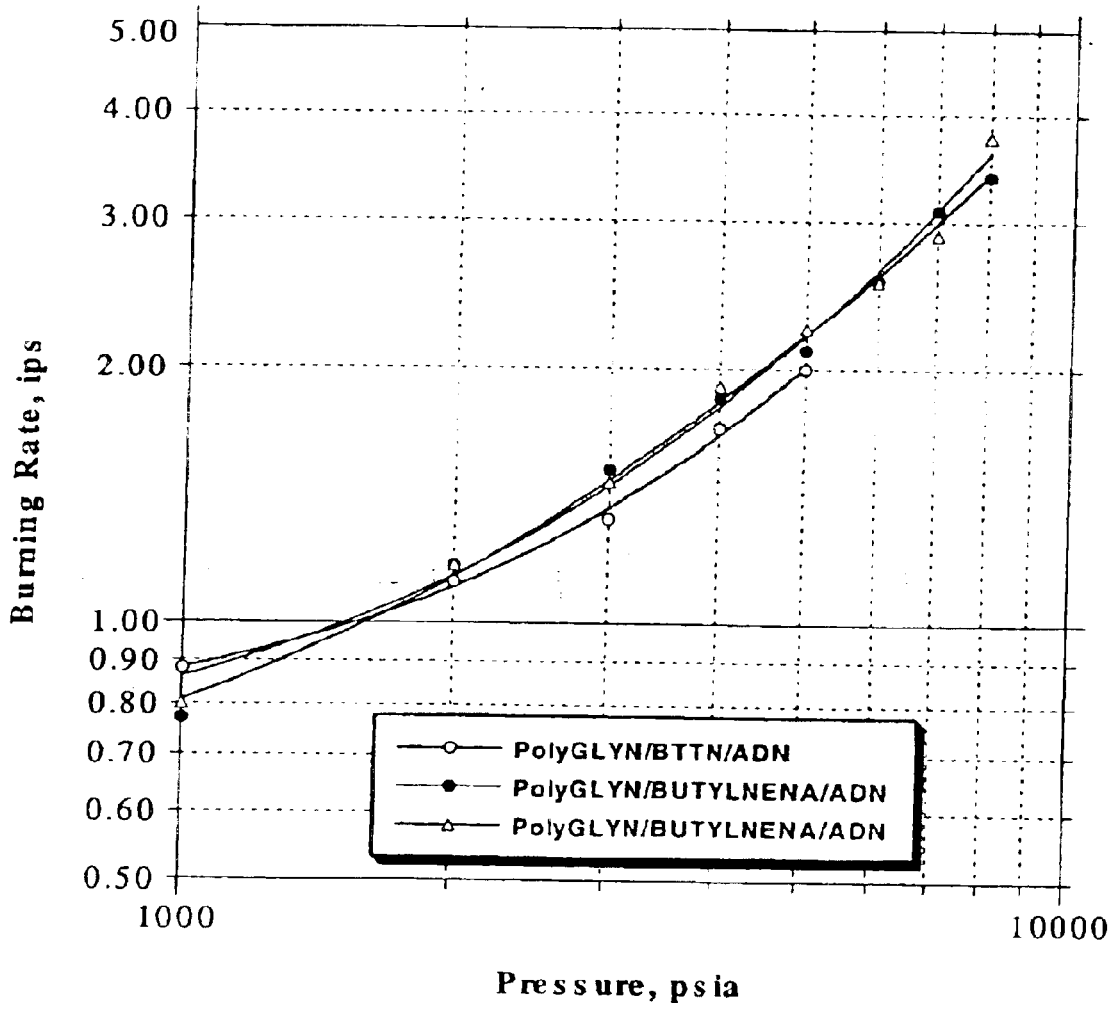
FIG. 6 is a graph which illustrates the burn rate slope of preferred embodiments of the present invention in terms of chamber pressure versus burning rate for propellants containing PolyGlyn as a binder and ADN an oxidizer.

The results also showed that all propellant containing ORP-2A as the binder burned 10% faster than the corresponding propellants made with PCP as the binder, as shown in FIG. 3. For example, as shown in FIG. 4, the burning rate of a PCP-containing propellant was 0.71 in/s at 1000 psia versus 0.82 in/s for an ORP-2A-containing propellant at the same pressure. This increased burning rate could be attributable to the higher chemical energy content of the ORP-2A binder, since ORP-2A is an energetic binder whereas PCP is an inert polymer.

One of the unique combustion characteristics of this propellant is that its burning rate vs. pressure curve shows a slope of 0.68–0.69 without slope break. A pressure slope break is usually present in AP-containing propellants and is one of the limiting factors for their operation at high pressure. It is conceivable that ADN-based propellants could be used for high-pressure, high-performance motor applications. The pressure slope break in AP propellants is more thoroughly discussed in Atwood, A. I. et al., "High-pressure Burning Rate Studies of Ammonium Perchlorate (AP) Based Propellants," *Proceedings for Research and Technology Agency of North Atlantic Treaty Organization* (*NATO*) 1999 *Meeting on Small Rocket Motors and Gas Generators for Land, Sea, and Air Launched Weapon Systems*, 19–23 Apr. 1999, Corfu, Greece, incorporated by reference herein.

TABLE 5

| Propellant | Pressure, psi/Burning Rate, in/s | | | | | | | | |
|---|---|---|---|---|---|---|---|---|---|
| | 1K | 2K | 3K | 4K | 5K | 6K | 7K | 8K | Slope |
| PCP/NE/AND | 0.71 | 1.09 | 1.42 | 1.67 | 2.12 | 2.47 | 2.70 | 3.20 | 0.65 |
| PCP/NE/AND/ADNP | 0.74 | 1.18 | 1.58 | 1.94 | 2.31 | 2.65 | 2.95 | 3.46 | 0.68 |
| PCP/NE/ADNP/CL-20 | 0.65 | 1.04 | 1.48 | 1.68 | 2.04 | 2.43 | 2.69 | 3.04 | 0.68 |
| ORP-2A1NE/AND | 0.82 | 1.30 | 1.61 | 1.87 | 2.33 | 2.81 | 3.29 | 3.67 | 0.69 |
| ORP-2A/NE/ADN/ADNP | 0.86 | 1.28 | 1.68 | 2.07 | 2.46 | 2.86 | 3.33 | 3.67 | 0.70 |
| ORP-2A/NE/ADNP/CL-20 | 0.81 | 1.28 | 1.69 | 2.01 | 2.53 | 2.76 | 3.20 | 3.40 | 0.68 |
| PolyGlyn/TMETN/BTTN/ADN | 0.9 | 1.38 | 1.78 | 2.12 | 2.44 | — | — | — | 0.62 |
| PolyGlyn/TMETN/BTTN/ADNP/CL-20 | 0.86 | 1.39 | 1.85 | 2.27 | 2.66 | 3.02 | — | — | 0.7 |
| PolyGlyn/NE/ADN | 0.88 | 1.33 | 1.7 | 2.0 | 2.3 | — | — | — | 0.59 |
| PolyGlyn/ButylNENA/TMETN/ADNP/CL-20 | 0.77 | 1.17 | 1.52 | 1.85 | 2.11 | 2.55 | 3.09 | 3.38 | 0.71 |

Under certain experimental conditions, ADN can inhibit the curing of isocyanate polyurethane binder systems. As a result of extensive efforts, curing conditions specifically suited for the consistent manufacturing of ADN-based propellants were identified.

When standard curing procedures were used for ADN-based propellants, most of the material exhibited a soft cure. After experimenting with different cross linkers, the authors selected nitrocellulose (NC), which has shown to be more effective in building higher-tensile-strength ADN propellant. However, other crosslinkers are adequate for the formulations of the present invention. Propellants made with PCP binder have adequate mechanical properties—preliminary results from mini-tensile specimens indicated stress of 72 psi, modulus of 396 psi, and strain of 58% at ambient conditions. However, the ORP-2A-containing propellant was still soft with low stress and low modulus. The authors are currently working to further optimize the mechanical properties of the ORP-2A propellant by increasing the cross linker and curative levels.

In embodiments of the present invention, the propellant formulations produce no HCl in the exhaust. The exhaust consists mostly of $CO_2$, $H_2O$, $N_2$, and small amounts of CO. These exhaust species are friendlier and much less hazardous to the environment than those emitted by conventional AP-based propellants.

For each formulation, the mixing is accomplished using methods known in the art. The mixing of the aforementioned ingredients is accomplished by using a vertical shear mixer. At the end of mixing, the propellant mixture is vacuum cast into various molds or test items to determine various characteristics. For a more detailed description of mixing technique, refer to U.S. Pat. No. 5,712,511 issued to Chan et al. on Jan. 27, 1998, incorporated by reference herein.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A minimum signature solid propellant formulation comprising:

about 6.0 to about 9.0 weight % of at least one polymeric binder, wherein said binder comprises at least one of polycaprolactone;

about 21 to about 25 weight % of at least one energetic plasticizer;

about 25 to about 45 weight % of ammonium dinitramide prills having a particle size of about 100 $\mu$m to about 200 $\mu$m as an ADN prills oxidizer; and about 15 to about 25 weight % of CL-20.

2. The solid propellant formulation of claim 1, wherein said CL-20 has a particle size of about 3 $\mu$m.

3. The solid propellant formulation of claim 1, wherein said binder is further selected from the group consisting of poly(diethyleneglycol-4,8-dinitrazaundecanoate) and polyglycidyl nitrate.

4. The solid propellant formulation of claim 1, wherein said plasticizer is selected from the group consisting of butanetriol trinitrate, trimethylolethane trinitrate, n-butyl-2-nitratoethyl-nitramine and any combination thereof.

5. The solid propellant formulation of claims 1, further comprising at least one member selected from a curative, a stabilizer, a cure catalyst, crosslinker, a burn rate modifier and a bonding agent.

6. The solid propellant formulation of claim 5, wherein said curative is selected from the group consisting of hexamethylene diisocyanate, m-tetramethylxylene diisocyanate, dimeryl diisocyanate, toluene diisocyanate, polymeric hexamethylene diisocyanate, isophorone diisocyanate, biuret triisocyanate and any combination thereof.

7. The solid propellant formulation of claim 5, wherein said cure catalyst is selected from the group consisting of triphenyl bismuth triphenyltin chloride, dibutyltin diacetate and dibutyltin dilaurate.

8. The solid propellant formulation of claim 5, wherein said stabilizer is selected from the group consisting of N-methyl-p-nitroaniline and 2-NDPA (2-nitrodiphenylamine).

9. The solid propellant formulation of claim 5, wherein said burn rate modifier is carbon black.

10. The solid propellant formulation of claim 5, wherein said crosslinker is nitrocellulose.

11. A minimum signature solid propellant formulation comprising:

about 6.0 to about 9.2 weight % of at least one polymeric binder, wherein said polymeric binder is polycaprolactone;

about 21 to about 28 weight % of at least one energetic plasticizer;

about 35 to about 45 weight % of ammonium dinitramide prills having a particle size of about 100 μm to about 200 μm as an ADN prills oxidizer; and about 15 to about 25 weight % of CL-20.

12. The solid propellant formulation of claim 11, wherein said energetic plasticizer comprises:

about 4.0 to about 6.0 weight % of butanetriol trinitrate;

about 7.0 to about 9.0 weight % of trimethylolethane trinitrate; and about 10.0 to about 13.0 weight % of n-butyl-2-nitratoethyl-nitramine.

13. The solid propellant formulation of claim 11, further comprising at least one member selected from a curative, a stabilizer, a cure catalyst, crosslinker, a burn rate modifier and a bonding agent.

* * * * *